US009581096B2

(12) United States Patent
Klotz et al.

(10) Patent No.: US 9,581,096 B2
(45) Date of Patent: Feb. 28, 2017

(54) CONTROL METHOD FOR ADJUSTING THE HYDROCARBON CONCENTRATION IN AN ACTIVE CARBON FILTER OF A MOTOR VEHICLE

(71) Applicant: Bayerische Motoren Werke Aktiengesellschaft, Munich (DE)

(72) Inventors: Benjamin Klotz, Munich (DE); Franz Stocker, Seefeld (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/825,760

(22) Filed: Aug. 13, 2015

(65) Prior Publication Data

US 2015/0345414 A1 Dec. 3, 2015

Related U.S. Application Data

(63) Continuation of application No. PCT/EP2014/052851, filed on Feb. 13, 2014.

(30) Foreign Application Priority Data

Feb. 14, 2013 (DE) ..... 10 2013 202 433

(51) Int. Cl.
*F02M 25/08* (2006.01)
*F02D 41/00* (2006.01)
(Continued)

(52) U.S. Cl.
CPC ..... *F02D 41/0032* (2013.01); *F02D 41/0045* (2013.01); *F02D 41/042* (2013.01); *F02D 41/123* (2013.01); *F02D 2200/0802* (2013.01)

(58) Field of Classification Search
CPC ..... F02D 41/0032; F02D 41/004; F02D 41/0045; F02M 25/0818; F02M 25/0827
(Continued)

(56) References Cited

U.S. PATENT DOCUMENTS 5,806,304 A 9/1998 Price et al.
9,188,100 B2 * 11/2015 Fukui ..... B60W 20/00
(Continued)

FOREIGN PATENT DOCUMENTS

DE 199 44 388 A1 3/2001
DE 101 28 008 A1 3/2002
(Continued)

OTHER PUBLICATIONS

International Search Report dated May 12, 2014 with English translation (Six (6) pages).
(Continued)

*Primary Examiner* — Thomas Moulis
(74) *Attorney, Agent, or Firm* — Crowell & Moring LLP

(57) ABSTRACT

A control method for adjusting the hydrocarbon concentration in an active carbon filter of a tank ventilation device of a motor vehicle, includes the acts of: detecting an operational parameter of the internal combustion engine of the vehicle; determining the hydrocarbon content of a fuel tank gas mixture in the fuel tank ventilation device; and opening the tank ventilation valve of the tank ventilation device for a defined length of time in accordance with the determined hydrocarbon content when the operational parameter of the internal combustion engine displays an overrun mode or a standstill mode of the internal combustion engine generated by a start-stop system.

20 Claims, 2 Drawing Sheets

(51) Int. Cl.
*F02D 41/04* (2006.01)
*F02D 41/12* (2006.01)

(58) Field of Classification Search
USPC ..... 123/516–520
See application file for complete search history.

(56) References Cited

U.S. PATENT DOCUMENTS

| | | | | |
|---|---|---|---|---|
| 2001/0052339 | A1 | 12/2001 | Halleron et al. | |
| 2002/0096137 | A1* | 7/2002 | Kobayashi | B60K 6/485 123/179.4 |
| 2004/0231319 | A1 | 11/2004 | Weirich | |
| 2007/0163551 | A1 | 7/2007 | Ludwig et al. | |
| 2008/0271718 | A1 | 11/2008 | Schondorf et al. | |
| 2010/0229837 | A1 | 9/2010 | Peters et al. | |
| 2011/0029176 | A1* | 2/2011 | Rauner | F02D 29/02 701/22 |
| 2012/0168454 | A1 | 7/2012 | Hagen | |
| 2013/0081600 | A1* | 4/2013 | Fukui | F01N 3/101 123/520 |
| 2013/0213366 | A1 | 8/2013 | Weigl | |
| 2014/0236458 | A1* | 8/2014 | Guo | F02N 11/0829 701/112 |
| 2015/0121999 | A1* | 5/2015 | Dudar | F02D 41/221 73/114.39 |
| 2016/0273506 | A1* | 9/2016 | Misawa | F02D 41/042 |

FOREIGN PATENT DOCUMENTS

| | | | |
|---|---|---|---|
| DE | 101 31 798 | A1 | 1/2003 |
| DE | 10 2006 002 717 | B3 | 5/2007 |
| DE | 10 2009 020 292 | A1 | 12/2009 |
| DE | 10 2010 002 534 | A1 | 9/2010 |
| DE | 10 2010 048 313 | A1 | 4/2012 |
| DE | 10 2010 055 319 | A1 | 6/2012 |
| GB | 2 354 722 | A | 4/2001 |
| JP | 2006-132436 | A | 5/2006 |
| JP | 2008-38736 | A | 2/2008 |
| WO | WO 2011/152258 | A1 | 12/2011 |

OTHER PUBLICATIONS

German-language Search Report dated Jul. 8, 2013 with Partial English translation (Ten (10) pages).

* cited by examiner

CONTROL METHOD FOR ADJUSTING THE HYDROCARBON CONCENTRATION IN AN ACTIVE CARBON FILTER OF A MOTOR VEHICLE

CROSS REFERENCE TO RELATED APPLICATIONS

This application is a continuation of PCT International Application No. PCT/EP2014/052851, filed Feb. 13, 2014, which claims priority under 35 U.S.C. §119 from German Patent Application No. 10 2013 202 433.9, filed Feb. 14, 2013, the entire disclosures of which are herein expressly incorporated by reference.

BACKGROUND AND SUMMARY OF THE INVENTION

The present invention relates to a control method for adjusting the hydrocarbon concentration in an active carbon filter of a tank ventilation device of a motor vehicle, including the detection of an operational parameter of the internal combustion engine of the motor vehicle.

Such a control method is known, for instance, from DE 101 31 798 A1, in which is described a regeneration device for regenerating an active carbon filter. The regeneration device is activated when the internal combustion engine is in an overrun mode that is detected by the control method. The so-called loading status of the active carbon filter is determined by way of measured values that are detected on a lambda probe arranged downstream of the internal combustion engine. The loading state of the active carbon filter may thus only be determined using a gas mixture that is flowing downstream of the combustion engine and that is supplied to the exhaust treatment system.

The object of the invention is to provide a control method that permits more precise determination of the loading of the active carbon filter and offers additional options for regenerating the active carbon filter.

For attaining this object, a control method is provided that includes the following acts:

a) determining a hydrocarbon content of a tank gas mixture in the tank ventilation device; and b) opening a tank ventilation valve of the tank ventilation device for a defined length of time as a function of the determined hydrocarbon content, when the operational parameter of the internal combustion engine indicates an overrun mode or a standstill caused by a start-stop system of the internal combustion engine.

The determination of the hydrocarbon content in the tank ventilation device, which is arranged upstream of the internal combustion engine in terms of flow, permits improved and more precise determination of how strongly the active carbon filter is loaded with hydrocarbons. From this it is also possible to determine more precisely the need for regenerating the active carbon filter. Since the hydrocarbon content in the tank ventilation device is known, the active carbon filter may be regenerated not only during overrun operation of the internal combustion engine, but also during a temporary standstill thereof that is caused by a start-stop system.

In one refinement, the method detects the temperature of an exhaust treatment system of the motor vehicle, wherein the defined length of time the tank ventilation valve is opened is a function of the detected temperature of the exhaust treatment system.

This is intended to include, in particular, the temperature of a catalytic converter arranged downstream of the internal combustion engine. The normal operational temperature of a catalytic converter is about 300° C. to 800° C. The temperature of the catalytic converter is thus a function of the speed and load of the internal combustion engine. At appropriate temperatures in the catalytic converter, the supply to the catalytic converter of hydrocarbons that have not been combusted (or only some of which have been combusted) in the internal combustion engine in overrun mode leads to a subsequent reduction thereof in the exhaust gas flow due to oxidation or reduction.

It is preferred that the hydrocarbon content be determined by use of an HC sensor attached in the area of the tank ventilation device. The HC sensor should be arranged as best as possible such that it may determine a representative hydrocarbon content for the active carbon filter. The HC sensor is preferably disposed in a limited area between active carbon filter and tank ventilation lines that lead to and away therefrom. It is also possible for such an HC sensor to be built into an active carbon filter.

Alternatively, the hydrocarbon content may be determined by at least one characteristic value of a model for the hydrocarbon content in tank gases. Such a model may be embodied, for instance, such that it takes into account different parameters, especially determinant parameters, which affect the outgassing of the liquid fuel. With such a model, it is possible to model the hydrocarbon content of the part of a tank that is not filled with liquid fuel and the ventilation lines connected thereto. From the model, taking into account variables that may be provided by a control unit of the motor vehicle, such as for instance ambient temperature, cooling water temperature, ambient air pressure, downtimes of the combustion engine, values of acceleration sensors in the longitudinal and transverse directions, and fuel temperature, it is possible to estimate or derive values for a hydrocarbon content that is present in the tank ventilation device. It is also possible to take into account in such a model the geometry of the fuel container which, in conjunction with a fill level with liquid fuel, also has an effect on outgassing.

With the method it is further provided that the higher the temperature of the exhaust treatment system, the shorter the defined length of time for opening the tank ventilation valve. Such a control or regulation makes it possible, first of all, for the temperature of the exhaust treatment system to not be substantially changed, in particular to rise only slightly, due to introduced and chemically reacting hydrocarbons. By limiting the time the tank ventilation valve is open, it is possible for the operational temperature of the exhaust treatment system to remain in an optimal range and not rise above a maximum allowed operational temperature or drop below a minimum allowed operational temperature.

Furthermore, with the method, the length of time the tank ventilation valve is open may become shorter the higher is the hydrocarbon content. Because of this, it is possible to prevent too much hydrocarbon, especially non-combusted or only partially combusted hydrocarbon, from traveling into the exhaust system and thereby causing the temperature of the exhaust treatment system to rise too rapidly due to corresponding chemical (catalytic) reactions.

It is furthermore provided that the length of time that the tank ventilation valve is open be between 0.5 and 10 seconds, and that the temperature of the exhaust treatment system during the defined length of time the tank ventilation valve is open be between 300° C. and 800° C. The ranges disclosed here for the length of time the tank ventilation valve is open and for the temperature of the exhaust gas system may also be selected to be different as a function of the specifications and design of a control system for the internal combustion engine and the exhaust treatment system.

With the inventive control method, when the internal combustion engine of the motor vehicle is in overrun mode, when the tank ventilation valve is opened, the gas containing the hydrocarbon is preferably caused to be drawn from the tank ventilation device by a negative pressure that exists relative to the internal combustion engine. This negative pressure is affected by the opening of a throttle valve and the valves on the internal combustion engine. In this context, it is also possible for variably adjustable valves to be provided for the internal combustion engine so that enhanced control of the negative pressure in the intake area of the internal combustion engine may be attained. Using a negative pressure sensor arranged in an intake pipe, it is possible to adjust a more precise negative pressure of, for instance, approximately 100 mbar, in the intake pipe between the throttle valve and the valves during an overrun operation of the internal combustion engine. The tank ventilation valve is then only opened or closed and no additional regulation is required for how much the tank ventilation valve is opened.

Alternatively, if it is determined that the internal combustion engine is in a standstill, a tank gas pump provided in the area of the tank ventilation device may conduct the gas containing hydrocarbon to the internal combustion engine if the tank ventilation valve is opened. Instead of a tank gas pump, it is also possible to provide a compressed air reservoir that stores, for instance, negative or positive pressure from the engine operation and can provide the stored pressure in order to conduct the gas containing hydrocarbon to the internal combustion engine.

For instance, if regeneration of the active carbon filter begins immediately before a start-stop system brings the internal combustion engine to a standstill, then while the engine is at a standstill the negative pressure required for drawing the tank gases out of the tank ventilation device is lacking. However, in order to still make it possible to regenerate, even if the engine is at a standstill, during a certain length of time ventilation gases may be conducted by means of the pump or the compressed air reservoir out of the tank ventilation device into the intake manifold of the internal combustion engine or via the intake manifold through the combustion chamber into the exhaust system for a follow-on reaction. At least some of the tank ventilation gases that were introduced that remain in the intake pipe are then combusted during further operation of the internal combustion engine, in addition to an amount of fuel added (injected) into the cylinder.

For attaining the object cited in the foregoing, further provided is a motor vehicle comprising:

an internal combustion engine having at least one combustion chamber, an intake area supplying combustion air to at least one combustion chamber, and an exhaust area that draws off exhaust gasses from at least one combustion chamber;

an exhaust treatment system connected to the exhaust area of the internal combustion engine;

a tank ventilation device that opens into the intake area of the internal combustion engine and that is closed to the intake area using a tank ventilation valve; and a control unit for controlling the combustion engine and the exhaust treatment system, wherein the control unit is embodied to control the opening of the tank ventilation valve for a defined length of time in accordance with the described control method.

In one refinement, the motor vehicle may include a sensor, especially an HC sensor, arranged in the area of the tank ventilation device and/or the control unit which may be embodied to store characteristic values of a model of the hydrocarbon content and to control the length of time the tank ventilation valve is open, taking these characteristic values into consideration.

Other objects, advantages and novel features of the present invention will become apparent from the following detailed description of one or more preferred embodiments when considered in conjunction with the accompanying drawings.

DETAILED DESCRIPTION OF THE DRAWINGS

The invention shall now be described in greater detail, referencing one embodiment.

Figure 1:
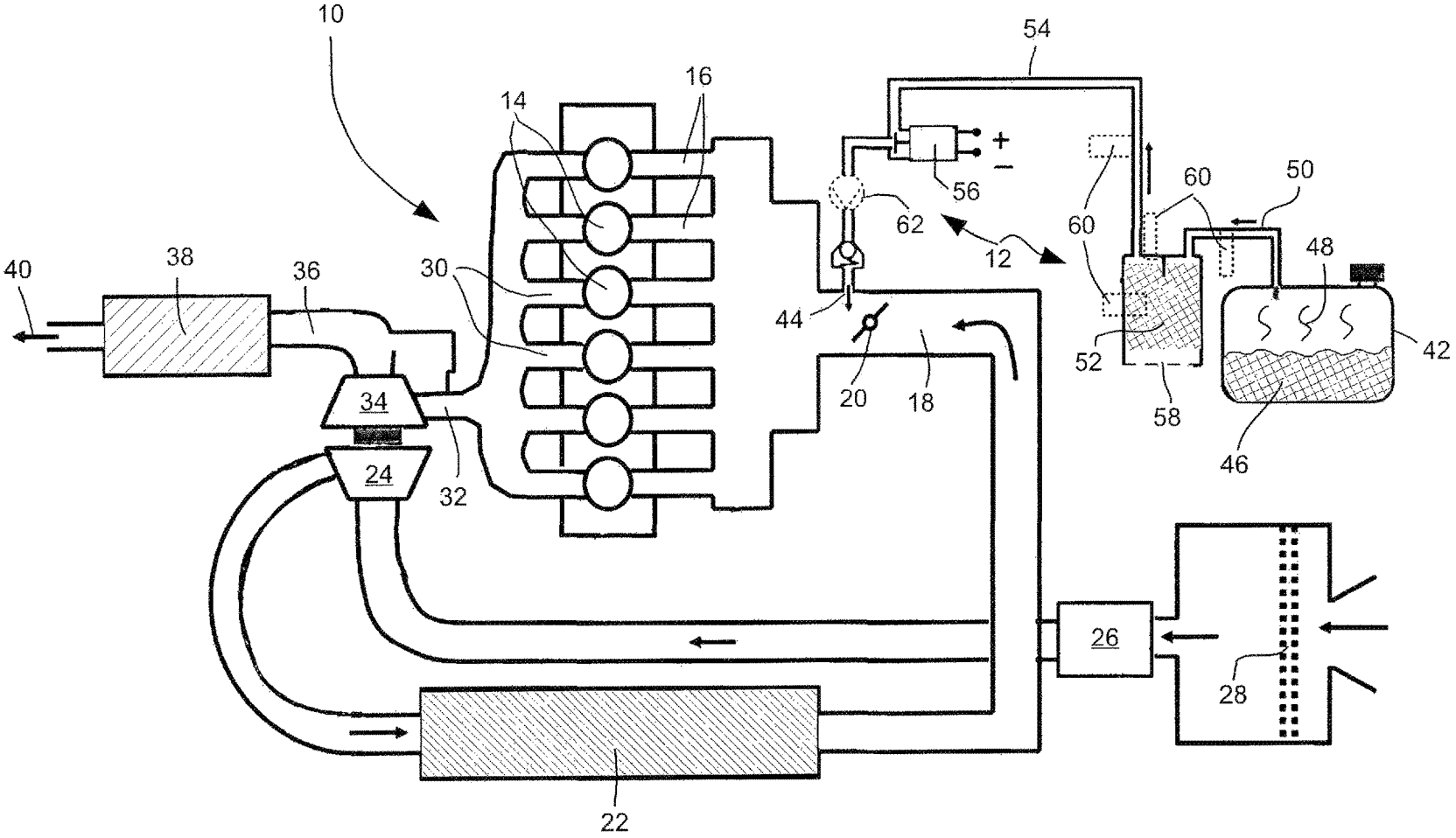
FIG. 1 is a schematic drawing illustrating the principle of one embodiment of a tank ventilation for performing the control method.

FIG. 1 is a schematic depiction and simplified illustration of the principle of an internal combustion engine 10 and a tank ventilation device 12 for a motor vehicle (not shown in greater detail). The internal combustion engine 10 may be a gas engine or a diesel engine and has a plurality of cylinders 14. Connected to the cylinders are intake pipes 16 that are fluidically connected to an intake manifold 18. A throttle valve 20 is shown in the intake manifold 18. Arranged in the course of the intake pipe 18 upstream in the direction of flow are a charge air cooler 22, a compressor 24 of a turbocharger, an air mass flow meter 26, and an air filter 28.

The internal combustion engine or motor 10 has on each cylinder 14 outlet pipes 30 that open into an exhaust pipe 32. This exhaust pipe 32 is connected to an exhaust turbine 34 that drives the compressor 24 of the turbocharger. An exhaust pipe 36 that opens into an exhaust treatment system or catalytic converter 38 leads away from the exhaust turbine 34. Treated exhaust gases travel from the catalytic converter 38 through an exhaust system (not shown) back into the ambient air, as the arrow 40 illustrates.

The tank ventilation device extends in a flow direction from a tank 42 to a ventilation opening 44 that is arranged in the flow path downstream of the throttle valve 20 in the intake manifold 18. In the example shown, the tank 42 is about half-full of fuel (gas, diesel, or the like) 46. Depending on various parameters, such as, for example, tank geometry, ambient temperature, and the like, a gas mixture 48 (tank gas) forms above the level of the fuel 46 and is guided through a first ventilation segment 50 of the tank ventilation device 12 to an active carbon filter 52. The hydrocarbons contained in the gas mixture 48 accumulate in the active carbon filter 52 so that the hydrocarbon concentration in the active carbon filter 52 increases. This causes the active carbon filter 52 to be so-called 'loaded' with hydrocarbons. A second ventilation segment 54 extends from the active carbon filter 52 to a tank ventilation valve 56. As a rule, the tank ventilation valve 56 is closed and opened as a function of specific parameters, which will be described in greater detail below, in order to permit the active carbon filter 52 to be regenerated or cleaned with fresh air. The fresh air may be drawn in through opening 58 on the active carbon filter 52. If the tank ventilation valve 56 is open, fresh air flows through the active carbon filter 52 and accumulates with the hydrocarbons that are present in the active carbon filter 52. The gas mixture escaping from the active carbon filter is conducted by the negative pressure in the intake manifold 18 to the ventilation opening 44 and then is led towards the internal combustion engine 10. This process reduces the hydrocarbon content or the hydrocarbon concentration in the active carbon filter 52, its so-called 'load.'

To obtain one parameter regarding hydrocarbon content in the tank ventilation device, a hydrocarbon sensor (HC sensor) 60 is provided that is arranged in the flow direction of the tank gas mixture, preferably upstream of the tank ventilation valve 56, as is indicated in FIG. 1 using four dotted-line rectangles 60 at various possible positions of the tank ventilation device 12. In order to obtain the most precise possible value for the hydrocarbon content in the active carbon filter 52, the HC sensor is arranged near thereto, or optionally is provided integrated therein.

Whether the active carbon filter 52 is to be regenerated by means of opening the tank ventilation valve 56 is determined based on an operational mode of the internal combustion engine 10 and the hydrocarbon content in the tank ventilation device 12. The tank ventilation valve 56 is opened if the operational mode of the internal combustion engine 10 indicates overrun mode or a standstill that has been initiated due to a start-stop system. The hydrocarbon content, which may also be expressed as HC saturation, has a value between 0 and 100%. A normal hydrocarbon content at which the active carbon filter 52 is regenerated or cleaned is about 0-80%. Furthermore, the goal is not to start the regeneration just when the hydrocarbon content reaches nearly 100%. The temperature of the catalytic converter 38 may be used as an additional parameter. For a catalytic converter in operation, the temperature is in a range of about 300° C. to about 800° C.

A length of time for opening the tank ventilation valve 56 may be determined depending on the hydrocarbon content and operational mode parameters for the internal combustion engine 10. For an operationally ready catalytic converter 38, the tank ventilation valve 56 may be opened for a length of time up to about 2 seconds, regardless of whether or not the temperature of the catalytic converter is taken into account. However, the length of time should be shorter for a higher hydrocarbon content to prevent too much hydrocarbon from traveling into the catalytic converter and raising the operational temperature thereof too high due to the chemical reactions.

Figure 2:
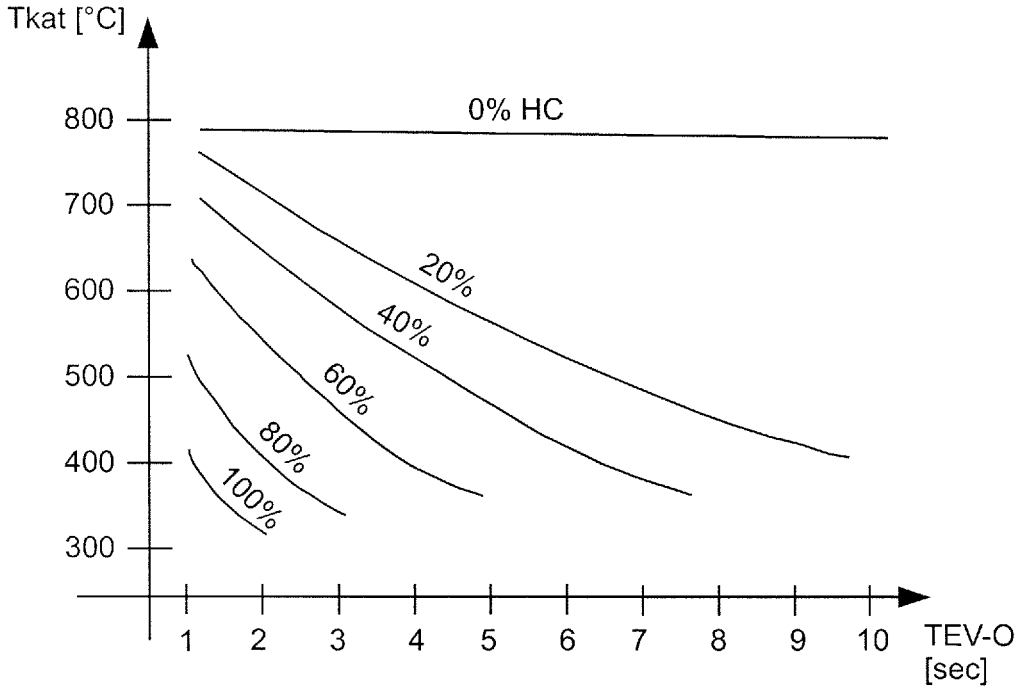
FIG. 2 is a graphical diagram that depicts the relationship between a hydrocarbon content, a length of time a tank ventilation valve is opened, and a temperature of an exhaust treatment system.

If the temperature of the catalytic converter 38 is optionally taken into account, the schematic diagram depicted in FIG. 2 results, from which diagram it is possible to take, qualitatively for a specific hydrocarbon content (0 to 100%), the maximum length of time TEV-O for opening the tank ventilation valve 56 at specific catalytic converter temperatures Tkat. The values entered on the X- and Y-axes shall be considered merely illustrative, and are intended only to clarify the exemplary embodiment. The temperature range for the Y-axis could also be from 250° C. to 750° C. or 900° C., and the length of time on the X-axis could be from 0.5 to 8 or 15 seconds. The figures presented here for the length of time for the tank ventilation valve 56 to be opened and for the catalytic temperature may also be selected to be different as a function of the specifications and design of the control system for the internal combustion engine 10 and the catalytic converter 38. It may be seen from the diagram that when the internal combustion engine 10 is in overrun mode, the length of time TEV-O must be shorter when the hydrocarbon content increases. Furthermore, as the hydrocarbon content increases, the maximum catalytic converter temperature at which the tank ventilation valve may still be opened for a brief length of time must be lower.

The following may be seen from the diagram of FIG. 2, for example. Given a hydrocarbon content of approximately 100%, with the design provided as an example, a length of time of approximately 1-2 seconds is possible if the catalytic converter temperature is between about 300 and 400° C. Given a hydrocarbon content of approximately 40%, the tank ventilation valve may be opened for approximately 1 to 8 seconds, wherein the catalytic converter temperature is in the range of approximately 400 and 700° C. As indicated in the foregoing, the length of time TEV-O is a function of how much hydrocarbon may travel through the internal combustion engine 10 to the catalytic converter so that the operational temperature of the catalytic converter 38 does not increase too sharply and a limiting value of approximately 800° C. is not exceeded in the chemical reactions that occur there with the supplied gas mixture.

Alternatively, to determine the hydrocarbon content by use of an HC sensor 60, it is possible to provide a model of the hydrocarbon content. Such a model is established using parameters that affect the out-gassing of the liquid fuel 46. With such a model it is possible to model the hydrocarbon content of the part of a tank 42 that is not filled with liquid fuel (above the level of the fuel 46) and thus the associated ventilation lines 50 and 54. From the model, taking into account the variables that may be provided by a control unit of the motor vehicle, such as for instance ambient temperature, cooling water temperature, ambient air pressure, down times of the internal combustion engine, values from acceleration sensors in the longitudinal/transverse direction, and/or fuel temperature, it is possible to estimate or derive values for a hydrocarbon content present in the tank ventilation device 12. It is also possible to take into account in such a model the geometry of the fuel tank 42; the geometry in conjunction with the fill level with liquid fuel 46 also has an effect on the outgassing.

As an alternative to overrun mode, the active carbon filter 52 may also be regenerated or cleaned given a determined standstill of the internal combustion engine. To this end, an optionally provided tank gas pump 62 (illustrated with dotted line) may convey the gas containing the hydrocarbon to the internal combustion engine 12 when the tank ventilation valve 56 is open. The installation location for the tank gas pump 62 may be selected along the line system for the tank ventilation device and may also be provided in the area of the line segment 54 or in the area of the fresh air supply at the openings 58. If a regeneration of the active carbon filter 52 begins, for instance, immediately before a start-stop system brings the internal combustion engine 10 to a standstill, during the standstill the internal combustion engine 10 lacks the negative pressure required to draw the tank gases out of the tank ventilation device 12. However, to make it possible to further regenerate, even during a standstill of the internal combustion engine 10, ventilation gases may be conducted from the tank ventilation device 12 into the intake manifold 18 of the internal combustion engine 10 by means of the tank gas pump 62 during a defined length of time. These tank ventilation gases introduced in the intake pipe are then combusted during continued operation of the internal combustion engine 10, in addition to an amount of fuel added (injected) into the cylinder 14. The air/fuel mixture added to the cylinders 14 is adjusted or regulated taking into account the hydrocarbon content included in the tank gas.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A control method for adjusting hydrocarbon concentration in an active carbon filter of a tank ventilation device of a motor vehicle, the method comprising the acts of:

detecting an operational parameter of the internal combustion engine of the motor vehicle;

determining a hydrocarbon content of a tank gas mixture in the tank ventilation device; and opening a tank ventilation valve of the tank ventilation device for a defined length of time as a function of the determined hydrocarbon content when the operational parameter of the internal combustion engine indicates an overrun mode or a standstill caused by a start-stop system of the internal combustion engine.

2. The control method according to claim 1, further comprising the act of:

detecting a temperature of an exhaust treatment system of the motor vehicle, wherein the defined length of time that the tank ventilation valve is open is additionally a function of the detected temperature of the exhaust treatment system.

3. The control method according to claim 1, wherein the act of determining the hydrocarbon content is carried out via an HC sensor attached in an area of the tank ventilation device.

4. The control method according to claim 2, wherein the act of determining the hydrocarbon content is carried out via an HC sensor attached in an area of the tank ventilation device.

5. The control method according to claim 1, wherein the act of determining the hydrocarbon content comprises the act of determining the hydrocarbon content from at least one characteristic value of a model for the hydrocarbon content in tank gases.

6. The control method according to claim 2, wherein the act of determining the hydrocarbon content comprises the act of determining the hydrocarbon content from at least one characteristic value of a model for the hydrocarbon content in tank gases.

7. The control method according to claim 2, wherein the higher the temperature of the exhaust treatment system, the shorter the defined length of time for opening the tank ventilation valve.

8. The control method according to claim 3, wherein the higher the temperature of the exhaust treatment system, the shorter the defined length of time for opening the tank ventilation valve.

9. The control method according to claim 5, wherein the higher the temperature of the exhaust treatment system, the shorter the defined length of time for opening the tank ventilation valve.

10. The control method according to claim 1, wherein the higher the hydrocarbon content, the shorter the defined length of time the tank ventilation valve is opened.

11. The control method according to claim 7, wherein the higher the hydrocarbon content, the shorter the defined length of time the tank ventilation valve is opened.

12. The control method according to claim 2, wherein the defined length of time that the tank ventilation valve is open it between 0.5 and 10 seconds, and the temperature of the exhaust treatment system during the defined length of time the tank ventilation valve is open is between 300° C. and 800° C.

13. The control method according to claim 1, further comprising the act of:

when the tank ventilation valve is open and the internal combustion engine is in overrun mode, drawing the tank gas mixture containing the hydrocarbon content from the tank ventilation device via a negative pressure existing relative to the internal combustion.

14. The control method according to claim 1, further comprising the act of:

when the tank ventilation valve is open, conducting the tank gas mixture containing the hydrocarbon content to the internal combustion engine via a tank gas pump provided in an area of the tank ventilation device.

15. A motor vehicle, comprising:

an internal combustion engine having at least one combustion chamber, an intake area supplying combustion air to the at least one combustion chamber, and an exhaust area that draws off exhaust gases from the at least one combustion chamber;

an exhaust treatment system connected to the exhaust area of the internal combustion engine;

a tank ventilation device that opens into the intake area of the internal combustion engine, the tank ventilation device being openable and closable with respect to the intake area via a tank ventilation valve; and a control unit operatively configured to control the internal combustion engine, the exhaust treatment system and the tank ventilation device, wherein the control unit controls opens the tank ventilation valve of the tank ventilation device for a defined length of time as a function of hydrocarbon content of a tank gas mixture when an operational parameter of the internal combustion engine indicates an overrun mode or a standstill caused by a start-stop system of the internal combustion engine.

16. The motor vehicle according to claim 15, further comprising:

an HC sensor arranged in an area of the tank ventilation device, wherein the HC sensor determines the hydrocarbon content of the tank gas mixture in the tank ventilation device.

17. The motor vehicle according to claim 16, wherein the control unit stores characteristic values of a model of the hydrocarbon content of the tank gas mixture and controls the defined length of time the tank ventilation valve is open as a function of the stored characteristic values.

18. The motor vehicle according to claim 15, further comprising:

a temperature sensor that determines a temperature of the exhaust treatment system of the motor vehicle, wherein the control unit controls the opening of the tank ventilation valve for the defined length of time additionally as a function of the determined temperature of the exhaust treatment system.

19. The motor vehicle according to claim 16, further comprising:

a temperature sensor that determines a temperature of the exhaust treatment system of the motor vehicle, wherein the control unit controls the opening of the tank ventilation valve for the defined length of time additionally as a function of the determined temperature of the exhaust treatment system.

20. The motor vehicle according to claim 17, further comprising:

a temperature sensor that determines a temperature of the exhaust treatment system of the motor vehicle, wherein the control unit controls the opening of the tank ventilation valve for the defined length of time additionally as a function of the determined temperature of the exhaust treatment system.

* * * * *